US006702025B2

(12) United States Patent
Meaders

(10) Patent No.: US 6,702,025 B2
(45) Date of Patent: Mar. 9, 2004

(54) HYDRAULIC CONTROL ASSEMBLY FOR ACTUATING A HYDRAULICALLY CONTROLLABLE DOWNHOLE DEVICE AND METHOD FOR USE OF SAME

(75) Inventor: Michael Wade Meaders, Pilot Point, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 34 days.

(21) Appl. No.: 10/073,621

(22) Filed: Feb. 11, 2002

(65) Prior Publication Data

US 2003/0150619 A1 Aug. 14, 2003

(51) Int. Cl.[7] ..... E21B 34/10
(52) U.S. Cl. ..... 166/335; 166/360; 166/381
(58) Field of Search ..... 166/335, 363, 166/351, 360, 381

(56) References Cited

U.S. PATENT DOCUMENTS

| | | | | | |
|---|---|---|---|---|---|
| 3,179,179 | A | | 4/1965 | Kofahl | 166/66.5 |
| 3,196,958 | A | | 7/1965 | Travers et al. | 175/7 |
| 3,313,346 | A | | 4/1967 | Cross | 166/5 |
| 3,315,741 | A | | 4/1967 | Triplett | 166/5 |
| 3,346,045 | A | | 10/1967 | Knapp et al. | 166/5 |
| 3,426,858 | A | | 2/1969 | Bauer et al. | 175/7 |
| 3,647,245 | A | * | 3/1972 | Hanes et al. | 285/106 |
| 3,693,714 | A | * | 9/1972 | Baugh | 166/348 |
| 3,743,013 | A | * | 7/1973 | Harbonn | 166/368 |
| 3,809,502 | A | | 5/1974 | Henry | 417/225 |
| 4,095,421 | A | * | 6/1978 | Silcox | 60/398 |
| 4,216,834 | A | | 8/1980 | Wardlaw | 175/7 |
| 4,240,506 | A | | 12/1980 | Dareing | 166/367 |
| 4,284,143 | A | | 8/1981 | Scherrer et al. | 166/350 |
| 4,336,415 | A | | 6/1982 | Walling | 174/47 |
| 4,388,022 | A | | 6/1983 | Gentry et al. | 405/195 |
| 4,406,598 | A | | 9/1983 | Walling | 417/404 |
| 4,429,620 | A | | 2/1984 | Burkhardt et al. | 91/395 |
| 4,442,902 | A | | 4/1984 | Doremus et al. | 166/374 |
| 4,945,995 | A | | 8/1990 | Tholance et al. | |
| 4,967,843 | A | | 11/1990 | Corteville et al. | 166/366 |
| 4,990,076 | A | | 2/1991 | Lynch et al. | 422/112 |
| 5,429,036 | A | | 7/1995 | Latos | 91/181 |
| 5,671,811 | A | | 9/1997 | Head | 166/346 |
| 5,730,554 | A | | 3/1998 | Mosley et al. | 405/195.1 |
| 5,778,981 | A | | 7/1998 | Head | 166/345 |
| 5,897,095 | A | | 4/1999 | Hickey | 251/57 |
| 6,018,501 | A | | 1/2000 | Smith et al. | 367/134 |
| 6,026,905 | A | | 2/2000 | Garcia-Soule | 166/336 |
| 6,041,804 | A | | 3/2000 | Chatufale | 137/15 |
| 6,053,202 | A | | 4/2000 | Cunningham | 137/596.16 |
| 6,179,057 | B1 | * | 1/2001 | Fontana et al. | 166/363 |
| 6,269,874 | B1 | | 8/2001 | Rawson et al. | 166/53 |
| 6,296,066 | B1 | | 10/2001 | Terry et al. | 175/92 |
| 2003/0037544 | A1 | * | 2/2003 | Armstrong | 60/413 |

FOREIGN PATENT DOCUMENTS

| | | | | |
|---|---|---|---|---|
| EP | 0 310 506 | A1 | 9/1988 | E21B/43/01 |
| EP | 1 138 872 | A1 | 10/2001 | |
| GB | 2 350 382 | A | 11/2000 | |
| WO | WO 01/61144 | A1 | 8/2001 | |
| WO | WO 01/65061 | A1 | 9/2001 | |

* cited by examiner

*Primary Examiner*—Hoang Dang
(74) *Attorney, Agent, or Firm*—Lawrence Youst

(57) ABSTRACT

A hydraulic control assembly (80) for actuating a hydraulically controllable downhole device (100) comprises a hydraulic fluid source (82) located on a surface installation that supplies a low pressure hydraulic fluid, an umbilical assembly (88) coupled to the hydraulic fluid source (82) that provides a supply fluid passageway for the low pressure hydraulic fluid and a subsea intensifier (90) operably associated with a subsea wellhead. The subsea intensifier (90) is operable to convert the low pressure hydraulic fluid from the hydraulic fluid source (82) into a high pressure hydraulic fluid for actuating the hydraulically controllable downhole device (100).

34 Claims, 3 Drawing Sheets

HYDRAULIC CONTROL ASSEMBLY FOR ACTUATING A HYDRAULICALLY CONTROLLABLE DOWNHOLE DEVICE AND METHOD FOR USE OF SAME

TECHNICAL FIELD OF THE INVENTION

The present invention relates, in general, to controlling the actuation of a downhole device and, in particular, to a hydraulic control assembly for actuating a hydraulically controllable downhole device using subsea intensification of a hydraulic fluid.

BACKGROUND OF THE INVENTION

Without limiting the scope of the present invention, its background will be described with reference to subsurface safety valves as an example.

Subsurface safety valves are commonly used to shut in oil and gas wells in the event of a failure or hazardous condition at the well surface. Such safety valves are typically fitted into the production tubing and operate to block the flow of formation fluid upwardly therethrough. The subsurface safety valve provides automatic shutoff of production flow in response to a variety of out of range safety conditions that can be sensed or indicated at the surface. For example, the safety conditions include a fire on the platform, a high or low flow line temperature or pressure condition or operator override.

During production, the subsurface safety valve is typically held open by the application of hydraulic fluid pressure conducted to the subsurface safety valve through an auxiliary control conduit which extends along the tubing string within the annulus between the tubing and the well casing. For example, flapper type subsurface safety valves utilize a closure plate which is actuated by longitudinal movement of a hydraulically actuated, tubular or rod type piston. The flapper valve closure plate is maintained in the valve open position by an operator tube which is extended by the application of hydraulic pressure onto the piston. Typically, a pump at the surface pressurizes hydraulic fluid from a hydraulic fluid reservoir that is also at the surface. The high pressure hydraulic fluid is then delivered through the control conduit to a variable volume pressure chamber of the subsurface safety valve to act against the crown of the piston. When, for example, the production fluid pressure rises above or falls below a preset level, the hydraulic control pressure is relieved such that the piston and operator tube are retracted to the valve closed position by a return spring. The flapper plate is then rotated to the valve closed position by, for example, a torsion spring or tension member.

It has been found, however, that as oil and gas wells are being drilled in deeper water, the hydrostatic pressure of the column of hydraulic fluid in the control conduit approaches the closing pressure of typical subsurface safety valves. Accordingly, stronger springs are required to generate the necessary closing pressure such that a subsurface safety valve installed in a deep water well may be operated to the closed position. It has been found, however, that use of these stronger springs increases the opening pressure required to operate the subsurface safety valve from the closed position to the open position as well as the pressure required to hold the subsurface safety valve in the open position. This in turn requires that the entire hydraulic system used to control these deep water subsurface safety valves must be operated at a higher pressure.

Therefore, a need has arisen for an apparatus and method for actuating subsurface safety valves installed in deep water wells wherein the hydrostatic pressure of the column of hydraulic fluid in the control conduit does not approach the closing pressure of the subsurface safety valves. A need has also arisen for such an apparatus and method that does not require the use of stronger springs in the subsurface safety valve to generate high closing pressures. Further, a need has arisen for such an apparatus and method that does not require the use of hydraulic systems having higher operating pressures to generate the higher opening and holding pressures required to overcome the higher spring forces of stronger springs.

SUMMARY OF THE INVENTION

The present invention disclosed herein comprises a hydraulic control assembly and method for actuating a hydraulically controllable downhole device that is installed in a deep water well. Using the hydraulic control assembly of the present invention, the hydrostatic pressure of the column of hydraulic fluid in the control conduit does not approach, for example, the closing pressure of the subsurface safety valve. Accordingly, subsurface safety valves installed in deep water wells using the hydraulic control assembly of the present invention do not require stronger springs for closure and do not require higher hydraulic opening pressures.

The hydraulic control assembly of the present invention includes a hydraulic fluid source located on a surface installation that is used to supply low pressure hydraulic fluid. An umbilical assembly is coupled to the hydraulic fluid source. The umbilical assembly provides a supply fluid passageway for the low pressure hydraulic fluid. A subsea intensifier that is operably associated with a subsea wellhead is coupled to the umbilical assembly. The subsea intensifier receives the low pressure hydraulic fluid from the umbilical assembly and pressurizes the low pressure hydraulic fluid into a high pressure hydraulic fluid suitable for actuating the hydraulically controllable device. The subsea intensifier may have one of several power sources. A surface hydraulic power source may be coupled to the subsea intensifier via the umbilical assembly or a surface electric power source may be coupled to the subsea intensifier via the umbilical assembly.

In another embodiment of the present invention, the hydraulic control assembly of the present invention includes a subsea hydraulic fluid source. A subsea intensifier is operable to convert the low pressure hydraulic fluid from the subsea hydraulic fluid source into a high pressure hydraulic fluid suitable for actuating the hydraulically controllable downhole device. An umbilical assembly may be coupled between the surface installation and the subsea intensifier to provide electrical power to the subsea intensifier. Alternatively, a subsea battery may provide electrical power, in which case the subsea intensifier may be controlled via wireless telemetry.

The method of the present invention includes storing a hydraulic fluid in a reservoir located on a surface installation, supplying low pressure hydraulic fluid from the reservoir via an umbilical assembly to a subsea intensifier which is operably associated with a subsea wellhead and converting the low pressure hydraulic fluid into high pressure hydraulic fluid suitable to actuate the hydraulically controllable downhole device. Alternatively, the method includes storing the hydraulic fluid in a subsea reservoir, pressurizing the hydraulic fluid with a subsea intensifier and actuating the hydraulically controllable downhole device.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
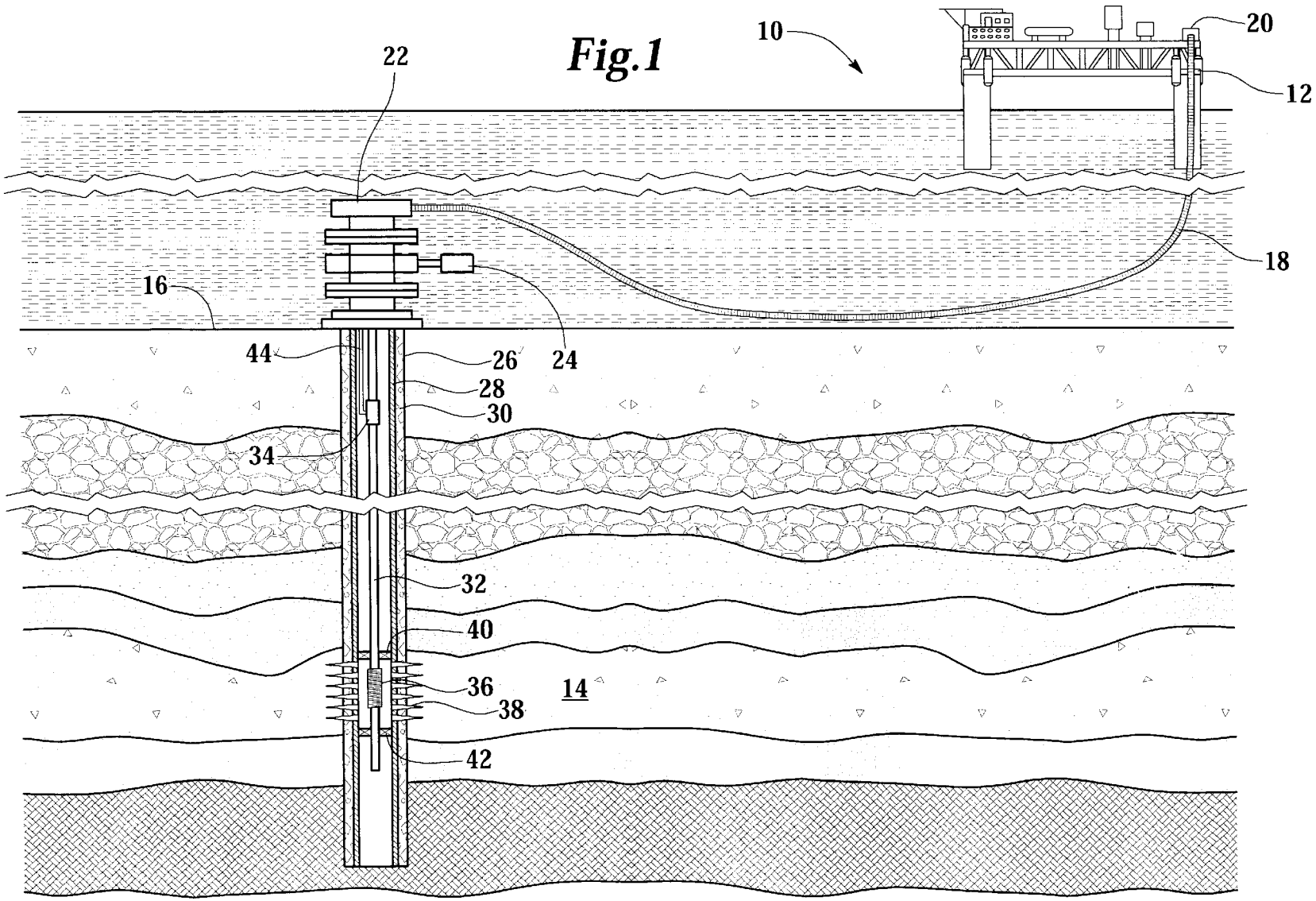
FIG. 1 is a schematic illustration of an offshore production platform operating a hydraulic control assembly of the present invention.

Referring initially to FIG. 1, a hydraulic control assembly in use during an offshore production operation is schematically illustrated and generally designated 10. A semi-submergible production platform 12 is positioned generally above a submerged oil and gas formation 14 located below a sea floor 16. An umbilical assembly 18 extends from control unit 20 on platform 12 to a subsea wellhead 22 at sea floor 16. Umbilical assembly 18 is flexible and able to adopt to the ocean currents as well as any drift of the surface installation 12. A subsea intensifier 24 is operably associated with subsea wellhead 22 and is in fluid communication with umbilical assembly 18.

A wellbore 26 extends from wellhead 22 through various earth strata including formation 14. A casing 28 is cemented within wellbore 26 by cement 30. A production tubing 32 is positioned within casing 28. Tubing string 32 includes a subsurface safety valve 34. In addition, tubing string 32 has a sand control screen 36 positioned proximate formation 14 such that production fluids may be produced through perforations 38 and into tubing string 32. A pair of packers 40, 42 isolate the production interval between tubing string 32 and casing 28. A hydraulic control line 44 extends from subsea intensifier 24 to subsurface safety valve 34. Even though FIG. 1 depicts a vertical well, it should be noted by one skilled in the art that the hydraulic control assembly of the present invention is equally well-suited for use in deviated wells, inclined wells, horizontal wells and other types of well configurations. In addition, even though FIG. 1 depicts a production well, it should be noted by one skilled in the art that the hydraulic control assembly of the present invention is equally well-suited for use in injection wells.

Figure 2:
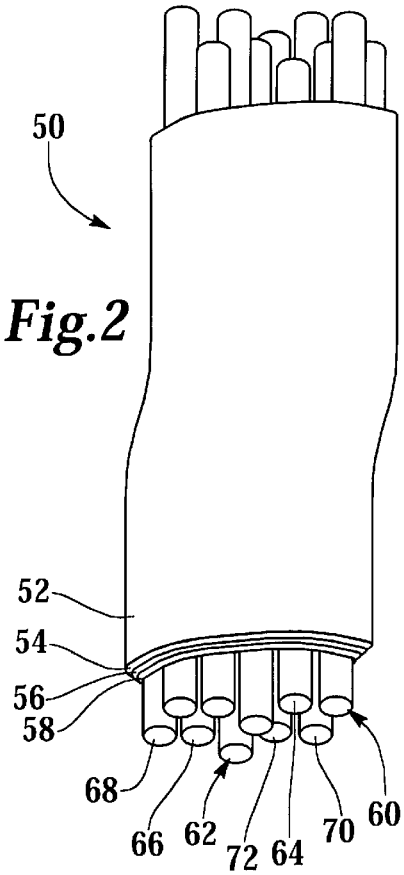
FIG. 2 is a side elevation view of an umbilical assembly of a hydraulic control assembly of the present invention.

Referring now to FIG. 2 therein is depicted an umbilical assembly 50 used in the hydraulic control assembly of the present invention. The umbilical assembly 50 includes an outer tube 52. Outer tube 52 may, for example, have an axial component with a Young's modulus of elasticity preferably in the range of 500,000 to 10,500,000 psi, may be non-isotropic and may have a modulus of elasticity is not the same in all axes nor is it linear. Outer tube 52 may be constructed of fibers such as nonmetallic fibers, metallic fibers, or a mixture of nonmetallic and metallic fibers. Outer tube 52 may be constructed from a helically wound or braided fibers reinforced with a thermoplastic or a thermosetting polymer or epoxy. Outer tube 52 is preferably made of a material having a density with a specific gravity approximately in the range of about 0.50 grams per cubic centimeter to about 3.25 grams per cubic centimeter. The composition of outer tube 52 allows umbilical assembly 50 to flex and bend with the horizontal and vertical movement of the ocean water and the drift of platform 12. It should be appreciated that the exact characteristics of umbilical assembly 50 such as Young's modulus, composition and specific gravity will be determined by a number of factors including the depth of sea floor 16, the horizontal and vertical currents of the ocean waters and the desired fluid capacity of umbilical assembly 50.

Umbilical assembly 50 preferably has a wear layer 54, an impermeable fluid liner 56 and a load carrying layer 58. Wear layer 54 is preferably braided around impermeable fluid liner 56. Wear layer 54 is a sacrificial layer that engages outer tube 52 to protect the underlying impermeable fluid liner 56 and load carrying layer 58. One preferred wear layer 54 is constructed from Kevlar™. Although only one wear layer 54 is shown, there may be additional wear layers as required.

Impermeable fluid liner 56 is an inner tube preferably made of a polymer, such as polyvinyl chloride or polyethylene. Impermeable fluid liner 56 can also be made of a nylon, other special polymer or elastomer. In selecting an appropriate material for impermeable fluid liner 56, consideration is given to the underwater environment in which umbilical assembly 50 will be deployed. The primary purpose of impermeable fluid liner 56 is to provide an impervious fluid barrier since fibers, such as the metallic fibers of outer tube 52 or a Kevlar™ wear layer 54 are not impervious to fluid migration after repeated contortions.

Load carrying layer 58 includes a sufficient number of fiber layers to sustain the load of umbilical assembly 50 in a fluid. Preferably, load carrying layer 58 is a plurality of resin layers wound into a thermal setting or a hybrid of glass and carbon fibers. The composition of load carrying layer 58 will depend upon the particular characteristics of the well such as the depth of the well. It should be appreciated that the exact composition of umbilical assembly 50 including the number and types of layers, such as outer layer 52, wear layer 54 and impermeable fluid liner 56, may vary. Umbilical assembly 50 however, must have all the properties required to enable the recovery of hydrocarbons from subsea wells. In particular, umbilical assembly 50 must have sufficient strength, flexibility and longevity when suspended in an oceanic environment.

A plurality of passageways 60 are housed within load carrying layer 58. Passageways 60 may be fluid passageways 62, such as hydraulic fluid passageways 64, 66 or production fluid passageways 68, 70. Fluid passageways 62 comprise a protective sheath defining a fluid cavity that is compatible with a variety of fluids, including hydraulic fluids, salt water and hydrocarbons. Such fluid passageways 62 are well known in the art. In addition, some passageways, such as passageway 76 may house electrical power conduits or electrical signal conduits. Electrical power conduits and electrical signal conduits preferably include one or more copper wires, multi-conductor copper wires, braided wires, or coaxial woven conductors bounded in a protective sheath. Additionally, any number of electrical conductors, data transmission conduits, sensor conduits, additional fluid passageways, or other types of systems may be positioned within load carrying layer 58.

Of particular importance in the present invention, umbilical assembly 50 is designed to carry low pressure hydraulic fluid and/or electrical power from the control unit 20 to subsea intensifier 24. Specifically, as explained in detail below, umbilical assembly 50 may be used to carry low pressure hydraulic fluid from a hydraulic fluid source on platform 12 to subsea intensifier 24 wherein the hydraulic fluid is pressurized to a suitably high pressure in order to operate a downhole hydraulically controllable device such as subsurface safety valve 34. The low pressure hydraulic fluid may be used not only as the supply fluid that is pressurized, but also, as the power source for operating a hydraulic pump or other pressurizing system that pressurizes the portion of the low pressure hydraulic fluid that serves as the supply fluid. The supply portion and power portion of the low pressure hydraulic fluid may travel together in the same passageway, for example fluid passageway 64 or may travel in separate passageways, for example fluid passageways 66 and 68. Alternatively, the power source for pressurizing the low pressure hydraulic fluid may be electricity carried in an electrical power conduit housed in a passageway 70.

Figure 3:
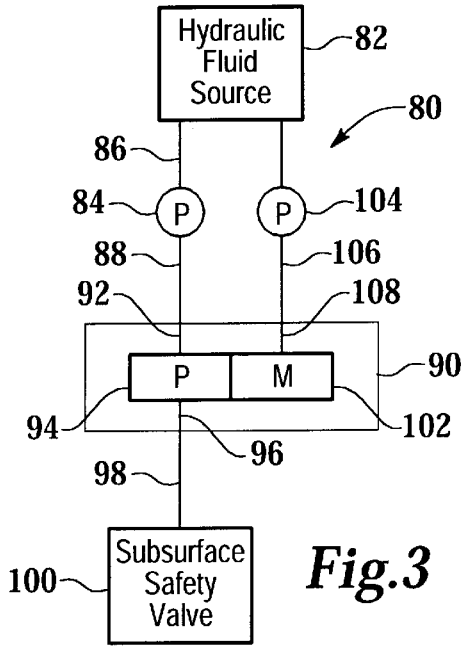
FIG. 3 is a fluid circuit diagram illustrating one embodiment of a hydraulic control assembly of the present invention wherein the hydraulic fluid source is positioned at a surface installation.

Referring now to FIG. 3, therein is depicted one embodiment of a hydraulic control assembly that is generally designated 80. Hydraulic control assembly 80 includes a hydraulic fluid source 82 that is positioned at a surface installation, such as platform 12 of FIG. 1. Hydraulic fluid source 82 houses a hydraulic fluid. A pump 84 in fluid communication with hydraulic fluid source 82 via fluid line 86 pumps the hydraulic fluid in a supply fluid passageway 88 at a relatively low pressure.

Supply fluid passageway 88 may, for example, be a passageway of the umbilical assembly. Supply fluid passageway 88 conveys the low pressure hydraulic supply fluid to a subsea intensifier 90. At subsea intensifier 90, low pressure line 92 conveys the low pressure hydraulic supply fluid from supply fluid passageway 88 to pump 94 where the low pressure hydraulic supply fluid is converted into high pressure hydraulic supply fluid. High pressure hydraulic supply fluid is conveyed via high pressure line 96 and control line 98 to hydraulically actuate a hydraulically controllable downhole device such as subsurface safety valve 100. Although subsurface safety valve 100 is being used as an example of a hydraulically actuatable downhole device, it should be appreciated by one skilled in the art that the hydraulically actuatable downhole device could alternatively be other downhole devices such as sliding sleeves, globe valves, downhole chokes or the like.

Pump 94 is driven by hydraulic motor 102. Power source 104, which is a hydraulic pump in this embodiment, provides hydraulic motor 102 with hydraulic power fluid via power fluid passageway 106, which is a passageway of an umbilical assembly. A fluid power line 108 couples the fluid passageway 106 to the hydraulic motor 102 at intensifier 90. In an alternative embodiment, the hydraulic supply fluid and hydraulic power fluid may be combined and carried in the same fluid passageway. For example, supply fluid passageway 88 may provide both low pressure hydraulic supply fluid to pump 94 and hydraulic power fluid to hydraulic motor 102.

Even though FIG. 3 has been described utilizing hydraulic motor 102 to drive hydraulic pump 94 in intensifier 90, it should be understood by those skilled in the art that other types of pressure intensifiers could alternatively be utilized. For example, a pressure intensifier utilizing one or more reciprocating pistons operating in response to area imbalances could be utilized.

Hydraulic control assembly 80 of the present invention allows high pressure hydraulic fluid to be generated from low pressure hydraulic fluid at a subsea location eliminating the need for a high pressure hydraulic line to run from the surface to the hydraulically controllable downhole device. Instead, the present invention utilizes an umbilical assembly to provide the fluid passageway for the low pressure hydraulic fluid. More specifically, the positioning of the subsea intensifier at the subsea wellhead and use of the umbilical assembly to traverse the distance between the surface installation and the subsea wellhead, which may be several thousand feet, greatly reduces the hydrostatic head in the column of hydraulic fluid in the control line that runs only from the subsea wellhead to the hydraulically controllable downhole device.

Figure 4:
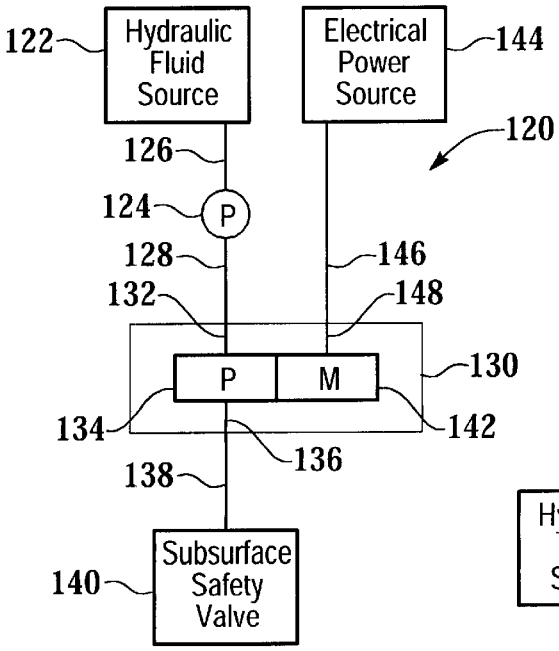
FIG. 4 is a fluid circuit diagram illustrating another embodiment of a hydraulic control assembly of the present invention wherein the hydraulic source is positioned at a surface installation.

Referring now to FIG. 4, therein is depicted another embodiment of a hydraulic control assembly of the present invention that is generally designated 120. Hydraulic control assembly 120 includes a hydraulic fluid source 122 that is positioned at a surface installation, such as platform 12 of FIG. 1. Hydraulic fluid source 122 houses a hydraulic fluid. A pump 124 in fluid communication with hydraulic fluid source 122 via fluid line 126 powers the hydraulic fluid at low pressure into a supply fluid passageway 128.

Supply fluid passageway 128 conveys the low pressure hydraulic fluid to a subsea intensifier 130. At subsea intensifier 130, low pressure line 132 conveys the low pressure hydraulic supply fluid from supply fluid passageway 128 to pump 134 where the low pressure hydraulic supply fluid is converted into high pressure hydraulic supply fluid. The high pressure hydraulic supply fluid is conveyed via high pressure line 136 and control line 138 to hydraulically actuate a hydraulically controllable downhole device such as subsurface safety valve 140.

Pump 134 is driven by electrical motor 142. Electrical power source 144, which is an electrical generator in this embodiment, provides electrical motor 142 with electrical power via electrical conduit 146, which is disposed in a passageway of the umbilical assembly. A power line 148 couples the electrical conduit 146 to the electrical motor 142 at intensifier 130. Electrical motor 142 is any motor hereto known or unknown in the art, such as a three-phase electrical induction motor that is energized by three-phase electrical power from the surface.

Figure 5:
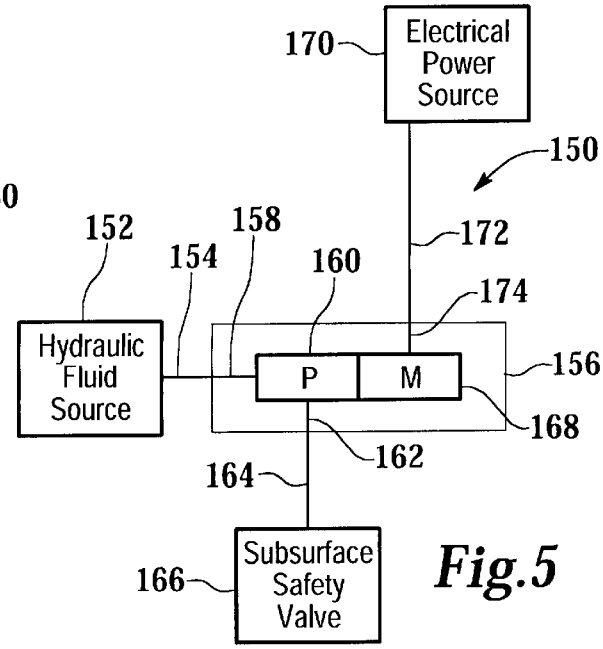
FIG. 5 is a fluid circuit diagram illustrating a further embodiment of a hydraulic control assembly of the present invention wherein the hydraulic source is positioned subsea.

Referring now to FIG. 5, therein is depicted another embodiment of a hydraulic control assembly of the present invention that is generally designated 150. Hydraulic control assembly 150 includes a hydraulic fluid source 152 that is positioned at a subsea location, such as at subsea wellhead 22 of FIG. 1. Hydraulic fluid source 152 houses a hydraulic fluid.

A supply fluid passageway 154 conveys the low pressure hydraulic supply fluid to a subsea intensifier 156. At subsea intensifier 156, low pressure line 158 conveys low pressure hydraulic supply fluid from supply fluid passageway 154 to pump 160 where the low pressure hydraulic supply fluid is converted into high pressure hydraulic supply fluid. The high pressure hydraulic fluid is conveyed via high pressure line 162 and control line 164 to hydraulically actuate a hydraulically controllable downhole device such as subsurface safety valve 166. As with the previous embodiments, although subsurface safety valve 166 is being used as an example of a hydraulically controllable downhole device, it should be appreciated by one skilled in the art that any hydraulically controllable downhole device could alternatively be actuated using the hydraulic control assembly of the present invention.

Pump 160 is driven by electrical motor 168. Electrical power source 170, which is an electrical generator in this embodiment, provides electrical motor 168 with electrical power via electrical conduit 172, which is housed within a passageway of the umbilical assembly. A power line 174 couples the electrical conduit 172 to the electrical motor 168 at intensifier 156.

Figure 6:
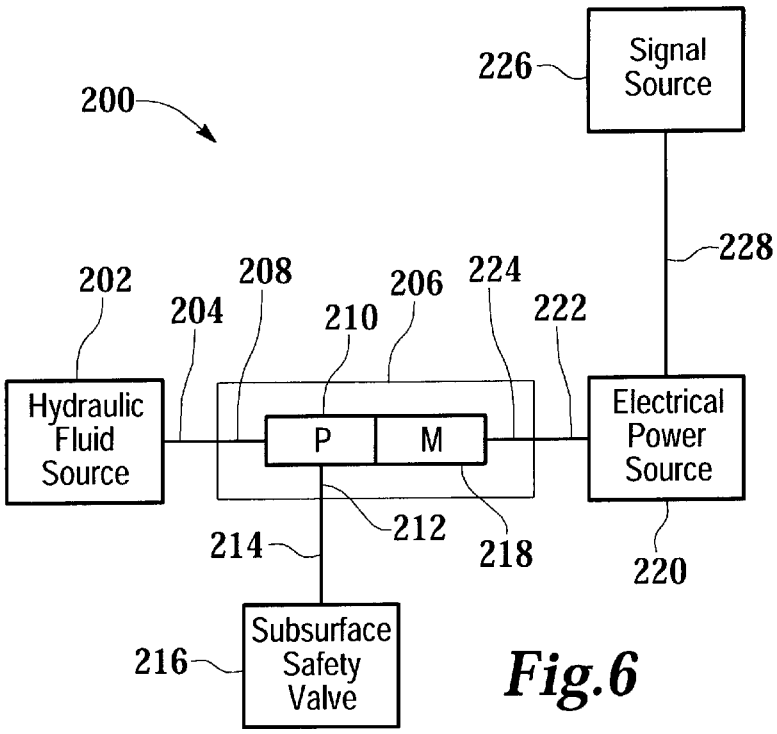
FIG. 6 is a fluid circuit diagram illustrating yet another embodiment of a hydraulic control assembly of the present invention wherein the hydraulic source is positioned subsea.

Yet another embodiment of the invention is shown in FIG. 6 and generally designated as hydraulic control assembly 200. Hydraulic control assembly 200 includes a hydraulic fluid source 202 that is positioned at a subsea location, such as at subsea wellhead 22 of FIG. 1. Hydraulic fluid source 202 houses a hydraulic fluid.

A supply fluid passageway 204 conveys the low pressure hydraulic supply fluid to a subsea intensifier 206. At subsea intensifier 206, low pressure line 208 conveys the low pressure hydraulic supply fluid from supply fluid passageway 204 to pump 210 where the low pressure hydraulic supply fluid is converted into high pressure hydraulic supply fluid. The high pressure hydraulic supply fluid is conveyed via high pressure line 212 and control line 214 to hydraulically actuate a hydraulically controllable downhole device such as subsurface safety valve 216.

Pump 210 is driven by electrical motor 218. Electrical power source 220, which is a battery in this embodiment, provides electrical motor 218 with electrical power via electrical conduit 222. Electrical power source 220 is located subsea, for example, coupled to subsea wellhead 22 of FIG. 1.

A power line 224 couples the electrical conduit 222 to the electrical motor 218 at intensifier 206. A signal source 226 positioned at the surface, at for example, surface installation 12 of FIG. 1, signals electrical power source 220 ON and OFF via signal conduit 228, which may be housed in a passageway of the umbilical assembly.

Figure 7:
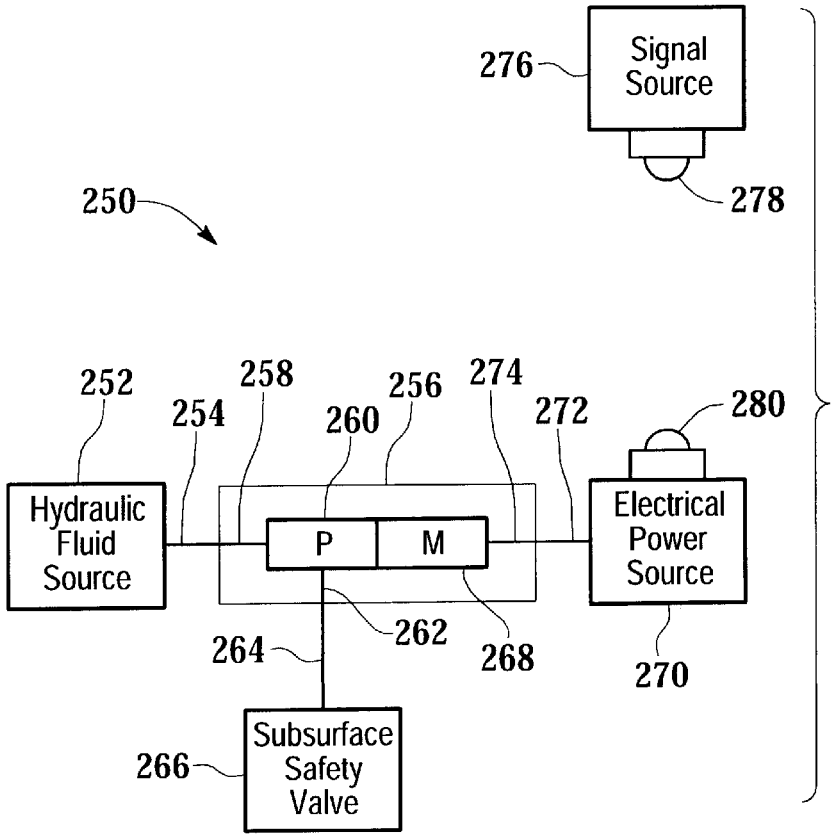
FIG. 7 is a fluid circuit diagram illustrating still a further embodiment of a hydraulic control assembly of the present invention wherein the hydraulic fluid source is positioned subsea.

A further embodiment of the present invention is illustrated in FIG. 7 and generally designated hydraulic control assembly 250. Hydraulic control assembly 250 includes a hydraulic fluid source 252 that is positioned at a subsea location, such as subsea wellhead 22 of FIG. 1. Hydraulic fluid source 252 houses a hydraulic fluid.

A supply fluid passageway 254 conveys the low pressure hydraulic supply fluid to a subsea intensifier 256. At subsea intensifier 256, low pressure line 258 conveys the low pressure hydraulic supply fluid from supply fluid passageway 254 to pump 260 where the low pressure hydraulic supply fluid is converted into high pressure hydraulic supply fluid. The high pressure hydraulic supply fluid is conveyed via high pressure line 262 and control line 264 to hydraulically actuate a hydraulically controllable downhole device such as subsurface safety valve 266.

Pump 260 is driven by electrical motor 268. Electrical power source 270, which is a battery in this embodiment, provides subsea intensifier 256 with electrical power via electrical conduit 272. Electrical power source 270 is located subsea, for example, coupled to subsea wellhead 22 of FIG. 1. A power line 274 couples the electrical conduit 272 to the electrical motor 268 at intensifier 256. A signal source 276 positioned at the surface, at for example, surface installation 12 of FIG. 1, signals electrical power source 270 ON and OFF via a wireless telemetry. Transceiver units 278, 280 are positioned at the signal source 276 and electrical power source 270, respectively, to generate and receive wireless signals. Wireless telemetry is well known in the art and could utilize, for example, acoustic signal and acoustic modems for such communications.

It should be appreciated by those skilled in the art that the hydraulic control assembly of the present invention advantageously overcomes the various limitations of the existing subsea actuator solutions. By employing a subsea intensifier at a subsea wellhead and conveying a low pressure hydraulic fluid through an umbilical assembly, a hydraulically controllable downhole device may be actuated efficiently and with greatly reduced cost.

Moreover, the hydraulic control assembly of the present invention provides an apparatus and method for actuating subsurface safety valves installed in wells located in deep water thereby overcoming the problems caused by the hydrostatic pressure of the column of hydraulic fluid in a control conduit running from a surface installation to the hydraulically controllable downhole device that is installed in deep water.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A hydraulic control assembly for actuating a hydraulically controllable downhole device comprising:

a hydraulic fluid source located on a surface installation that supplies a low pressure hydraulic fluid;

an umbilical assembly coupled to the hydraulic fluid source that provides a supply fluid passageway for the low pressure hydraulic fluid; and a subsea intensifier operably associated with a subsea wellhead and the umbilical assembly, the subsea intensifier operable to convert the low pressure hydraulic fluid into a high pressure hydraulic fluid that actuates the hydraulically controllable downhole device.

2. The hydraulic control assembly as recited in claim 1 wherein the subsea intensifier further comprises a hydraulic motor powered by a hydraulic power fluid.

3. The hydraulic control assembly as recited in claim 2 wherein the hydraulic power fluid is conveyed in a power fluid passageway of the umbilical assembly.

4. The hydraulic control assembly as recited in claim 2 wherein the hydraulic power fluid is derived from the low pressure hydraulic fluid.

5. The hydraulic control assembly as recited in claim 2 wherein the subsea intensifier further comprises a hydraulic pump driven by the hydraulic motor, the hydraulic pump generates the high pressure hydraulic fluid from the low pressure hydraulic fluid.

6. The hydraulic control assembly as recited in claim 1 wherein the subsea intensifier is operable to receive an electrical signal conveyed on an electrical signal conduit of the umbilical assembly.

7. The hydraulic control assembly as recited in claim 1 wherein the subsea intensifier is operable to receive a telemetric signal from the surface installation.

8. The hydraulic control assembly as recited in claim 7 wherein the telemetric signal is acoustic.

9. The hydraulic control assembly as recited in claim 1 wherein the subsea intensifier further comprises an electric motor powered by an electrical power signal.

10. The hydraulic control assembly as recited in claim 9 wherein the subsea intensifier further comprises a hydraulic pump driven by the electric motor, the hydraulic pump generates the high pressure hydraulic fluid from the low pressure hydraulic fluid.

11. The hydraulic control assembly as recited in claim 9 wherein the subsea intensifier is operable to receive an electrical power signal conveyed on an electrical power conduit of the umbilical assembly.

12. The hydraulic control assembly as recited in claim 9 wherein the electric motor is powered by a battery power supply operably associated with the electrical motor.

13. A hydraulic control assembly for actuating a hydraulically controllable downhole device comprising:

a hydraulic fluid source located on a surface installation that supplies a low pressure hydraulic supply fluid and a hydraulic power fluid;

an umbilical assembly coupled to the hydraulic fluid source that provides a supply fluid passageway for the low pressure hydraulic fluid and a power fluid passageway; and a subsea intensifier operably associated with a subsea wellhead and the umbilical assembly, the subsea intensifier having a hydraulic motor that is powered by the hydraulic power fluid and a hydraulic pump that is driven by the hydraulic motor, the hydraulic pump converts the low pressure hydraulic supply fluid into a high pressure hydraulic supply fluid to actuate the hydraulically controllable downhole device.

14. A hydraulic control assembly for actuating a hydraulically controllable downhole device comprising:

a subsea hydraulic fluid source that supplies a low pressure hydraulic fluid; and a subsea intensifier operably associated with a subsea wellhead and in fluid communication with the hydraulic fluid source, the subsea intensifier operable to convert the low pressure hydraulic fluid from the hydraulic fluid source into a high pressure hydraulic fluid that actuates the hydraulically controllable downhole device.

15. The hydraulic control assembly as recited in claim 14 wherein the subsea intensifier is operable to receive an electrical signal conveyed on an electrical signal conduit of an umbilical assembly that couples the subsea intensifier to a surface installation.

16. The hydraulic control assembly as recited in claim 14 wherein the subsea intensifier is operable to receive a telemetric signal from a surface installation.

17. The hydraulic control assembly as recited in claim 16 wherein the telemetric signal is acoustic.

18. The hydraulic control assembly as recited in claim 14 wherein the subsea intensifier further comprises an electric motor and a hydraulic pump that is driven by the electrical motor to generate the high pressure hydraulic fluid.

19. The hydraulic control assembly as recited in claim 18 further comprising an umbilical assembly coupling the subsea intensifier to a surface installation, the umbilical assembly having a power signal conduit that provides an electrical power signal to the electric motor.

20. The hydraulic control assembly as recited in claim 18 wherein the electric motor is powered by a battery power supply operably associated with the electrical motor.

21. A hydraulic control assembly for actuating a hydraulically controllable downhole device comprising:

a hydraulic fluid source operably associated with a subsea wellhead that supplies a low pressure hydraulic supply fluid; and a subsea intensifier operably associated with the hydraulic fluid source the subsea intensifier having a hydraulic pump that is driven by an electric motor operable to receive electrical power conveyed on an electrical power conduit of an umbilical assembly that couples the subsea intensifier to a surface installation, the hydraulic pump converts the low pressure hydraulic supply fluid from the hydraulic fluid source into a high pressure hydraulic supply fluid to actuate the hydraulically controllable downhole device.

22. A method of actuating a hydraulically controllable downhole device comprising the steps of:

storing a hydraulic fluid in a reservoir located on a surface installation;

pumping the hydraulic fluid at a first pressure from the reservoir through a supply fluid passageway of an umbilical assembly to a subsea intensifier operably associated with a subsea wellhead;

intensifying the pressure of the hydraulic fluid from the first pressure to a second pressure; and actuating the hydraulically controllable downhole device with the hydraulic fluid at the second pressure.

23. The method as recited in claim 22 further comprising electrically signaling the subsea intensifier.

24. The method as recited in claim 22 further comprising telemetrically signaling the subsea intensifier.

25. The method as recited in claim 22 further comprising acoustically signaling the subsea intensifier.

26. The method as recited in claim 22 further comprising hydraulically powering the subsea intensifier.

27. The method as recited in claim 22 further comprising electrically powering the subsea intensifier with an electrical power source supplied by a power conduit of the umbilical assembly.

28. The method as recited in claim 22 further comprising electrically powering the subsea intensifier with a battery source operably associated with the subsea intensifier.

29. A method of actuating a hydraulically controllable downhole device comprising the steps of:

storing a hydraulic fluid in a subsea hydraulic fluid reservoir at a first pressure;

intensifying the pressure of the hydraulic fluid with a subsea intensifier that is operably associated with a subsea wellhead; and actuating the hydraulically controllable downhole device in response to the hydraulic fluid.

30. The method as recited in claim 29 further comprising electrically signaling the subsea intensifier through a signal conduit of an umbilical assembly coupling a surface installation to the subsea intensifier.

31. The method as recited in claim 29 further comprising telemetrically signaling the subsea intensifier.

32. The method as recited in claim 29 further comprising acoustically signaling the subsea intensifier.

33. The method as recited in claim 29 further comprising electrically powering the subsea intensifier with an electrical power source supplied by a power conduit of an umbilical assembly coupling a surface installation to the subsea intensifier.

34. The method as recited in claim 29 further comprising electrically powering the subsea intensifier with a battery source operably associated with the subsea intensifier.

* * * * *